US008881893B1

(12) United States Patent
Cheng et al.

(10) Patent No.: US 8,881,893 B1
(45) Date of Patent: Nov. 11, 2014

(54) EYEGLASSES STORAGE BOX

(71) Applicants: Yung-Ching Cheng, Tainan (TW); Yung-Ming Cheng, Tainan (TW)

(72) Inventors: Yung-Ching Cheng, Tainan (TW); Yung-Ming Cheng, Tainan (TW)

( * ) Notice: Subject to any disclaimer, the term of this patent is extended or adjusted under 35 U.S.C. 154(b) by 0 days.

(21) Appl. No.: 13/940,415

(22) Filed: Jul. 12, 2013

(51) Int. Cl.
*B65D 43/16* (2006.01)
*A45C 11/04* (2006.01)

(52) U.S. Cl.
CPC ..... *A45C 11/04* (2013.01)
USPC ..... 206/6; 220/848; 220/845

(58) Field of Classification Search
USPC ..... 206/5, 6; 220/844, 843, 847, 848, 845
See application file for complete search history.

(56) References Cited

U.S. PATENT DOCUMENTS

| | | | | |
|---|---|---|---|---|
| 1,649,255 | A * | 11/1927 | Robinson | 206/5 |
| 3,317,078 | A * | 5/1967 | Gordon | 220/829 |
| 5,381,920 | A * | 1/1995 | Lin | 220/843 |
| 7,090,095 | B2 * | 8/2006 | Schafer | 220/826 |
| 8,016,153 | B2 * | 9/2011 | Boenig et al. | 220/847 |
| 8,573,715 | B1 * | 11/2013 | Jackman et al. | 312/34.4 |
| 2003/0000955 | A1 * | 1/2003 | Lee | 220/830 |

* cited by examiner

*Primary Examiner* — David Fidel
(74) *Attorney, Agent, or Firm* — Rosenberg, Klein & Lee

(57) ABSTRACT

An eyeglasses storage box includes a body connected with a transparent, and the body is pivotably connected to the cover by two pivotal members. The pivotal members each have an insertion which has a serrated surface formed on the outside thereof. The cover has engaging slots located corresponding to the insertions. The body has an inner case received therein which has two protrusions located corresponding to the pivotal members. The protrusions each have a recess for receiving the pivotal member. Two protection plates respectively cover the pivotal members. The eyeglasses can be seen via the transparent cover without opening the cover.

6 Claims, 6 Drawing Sheets

EYEGLASSES STORAGE BOX

BACKGROUND OF THE INVENTION

1. Fields of the Invention

The present invention relates to an eyeglasses storage box, and more particularly, to an eyeglasses storage box made by transparent material.

2. Descriptions of Related Art

There are many different types of eyeglasses such as sport glasses, sunglasses, watching glasses and safety glasses, and the rims of the eyeglasses are vary according to needs such as rimless eyeglasses or semi-rim glasses. An eyeglasses storage box is used to store the eyeglasses so as to protect the eyeglasses from being damage and getting dust.

The conventional eyeglasses storage box generally comprises a body having pivotal members on one side thereof so that a cover is pivotably connected to the body. The temples are folded and the eyeglasses can be stored in the storage box. The cover is then covered onto the body to hide the eyeglasses in the body. The conventional eyeglasses storage box is made by non-transparent material so that people cannot see through the storage box and be acknowledged the style of the eyeglasses.

The latest eyeglasses storage box is required to have aesthetic appearance so that the cover is made by transparent material so that the fashion eyeglasses can be seen via the cover. However, the pivotal portions of the eyeglasses are also exposed and which are not designed to have attractive appearance. Besides, the exposed pivotal portions may damage the lenses when operation.

The present invention intends to provide an eyeglasses storage box which improves the shortcomings mentioned above.

SUMMARY OF THE INVENTION

The present invention relates to an eyeglasses storage box and comprises a body connected with a transparent, and the body is pivotably connected to the cover by two pivotal members. The pivotal members each have an insertion which has a serrated surface formed on the outside thereof. The cover has engaging slots located corresponding to the insertions. The body has an inner case received therein which has two protrusions located corresponding to the pivotal members. The protrusions each have a recess for receiving the pivotal member. Two protection plates respectively cover the pivotal members. The eyeglasses can be seen via the transparent cover without opening the cover.

Preferably, the at least one pivotal member has a resilient plate and the protection plate has a guide slot in which the resilient plate is received. The inner case has a recess in which the resilient plate is received.

Preferably, the body has an outer case connected to the outside thereof.

Preferably, the serrated surface has diamond-shaped patterns, rectangular patterns, triangular patterns, rhombus patterns or wave pattern.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
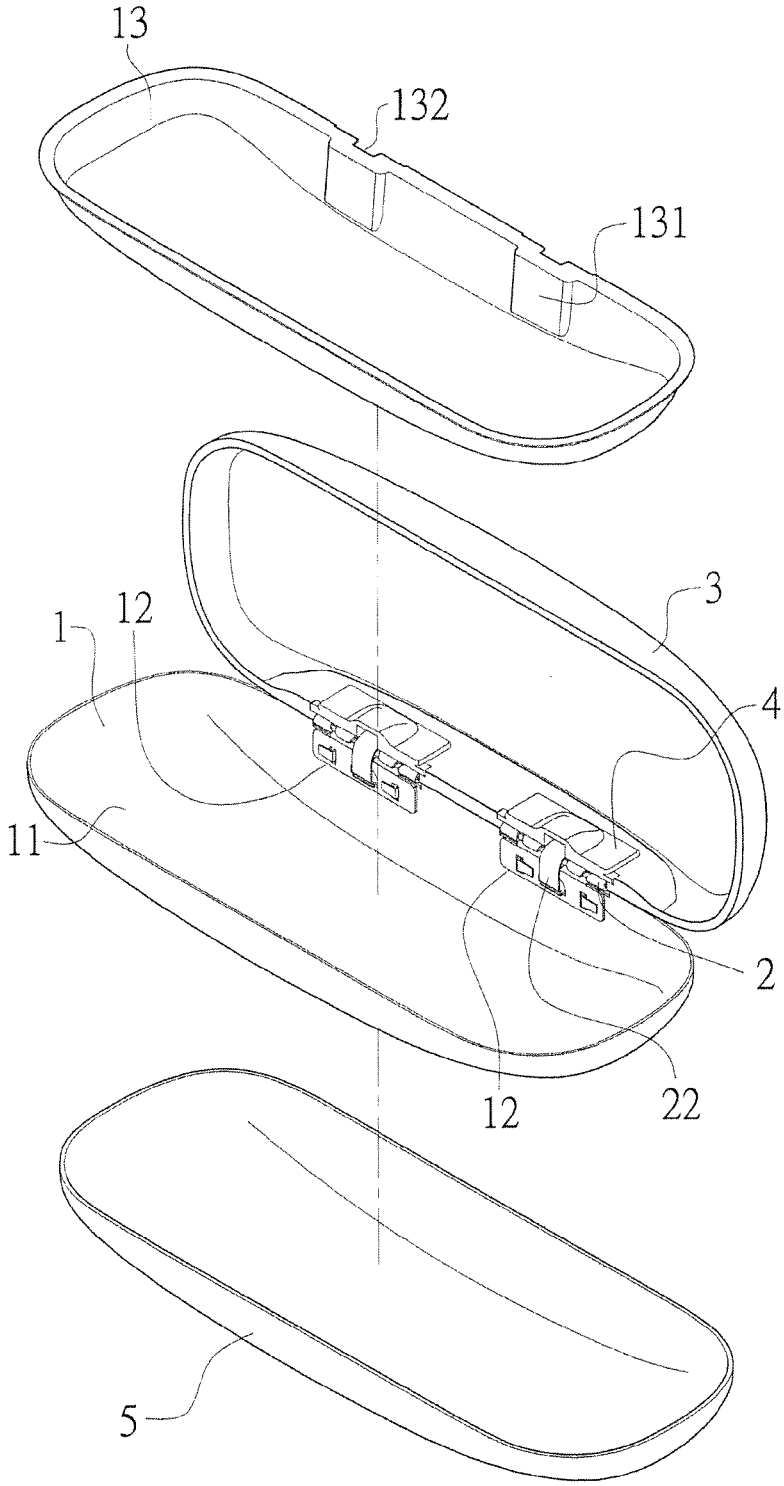
FIG. 1 is an exploded view to show the eyeglasses storage box of the present invention.
Figure 2:
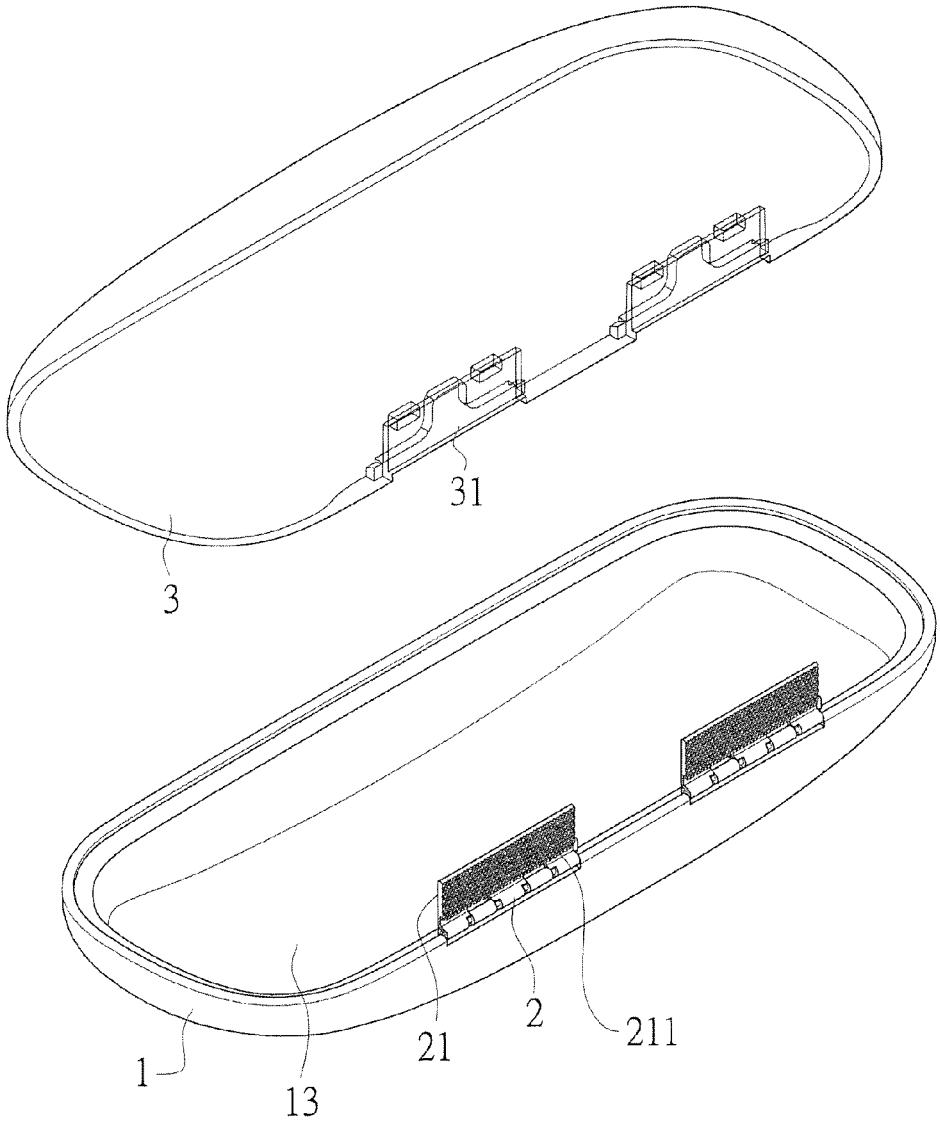
FIG. 2 shows the body and the cover of the eyeglasses storage box of the present invention.
Figure 3:
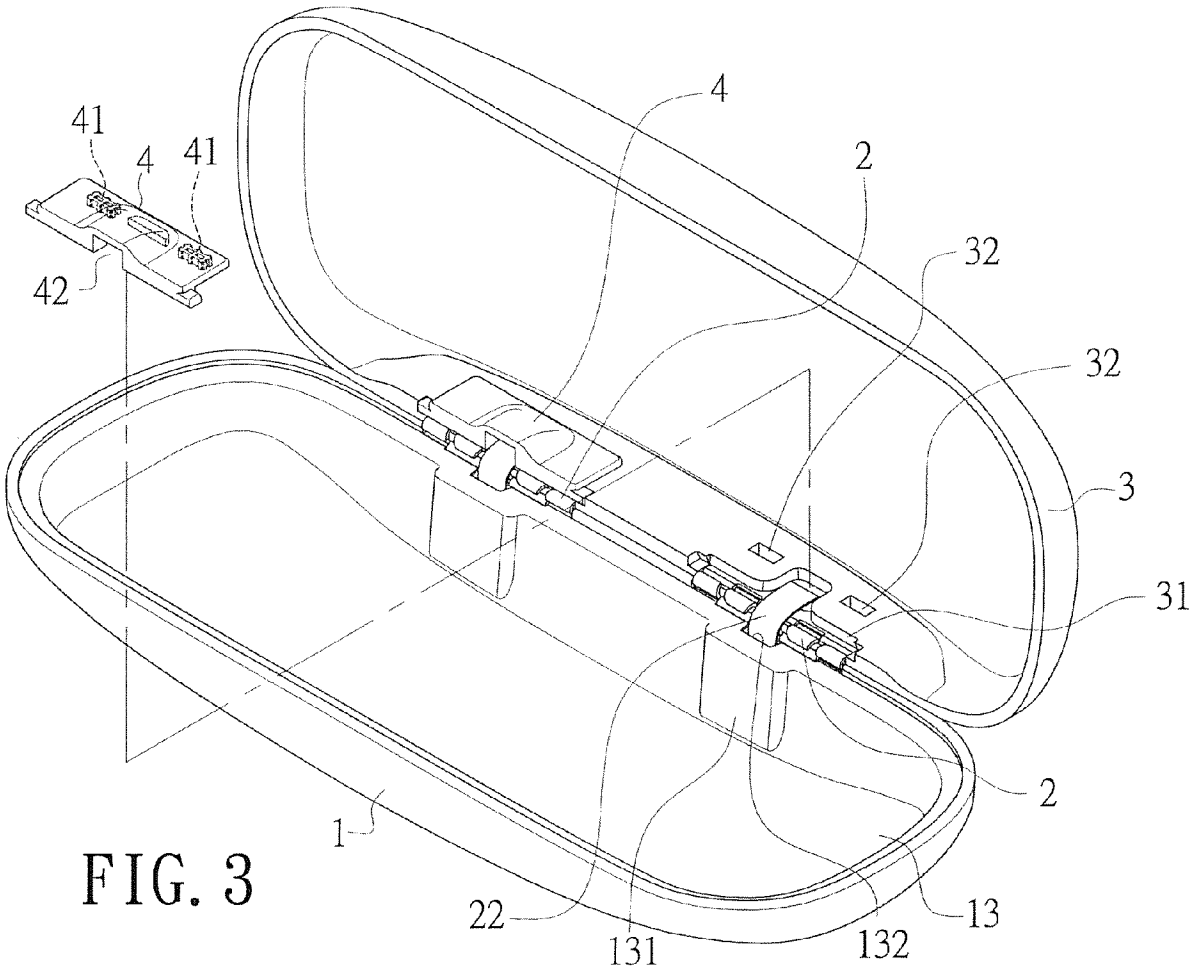
FIG. 3 shows the protection plates, the body and the cover of the eyeglasses storage box of the present invention.
Figure 4:
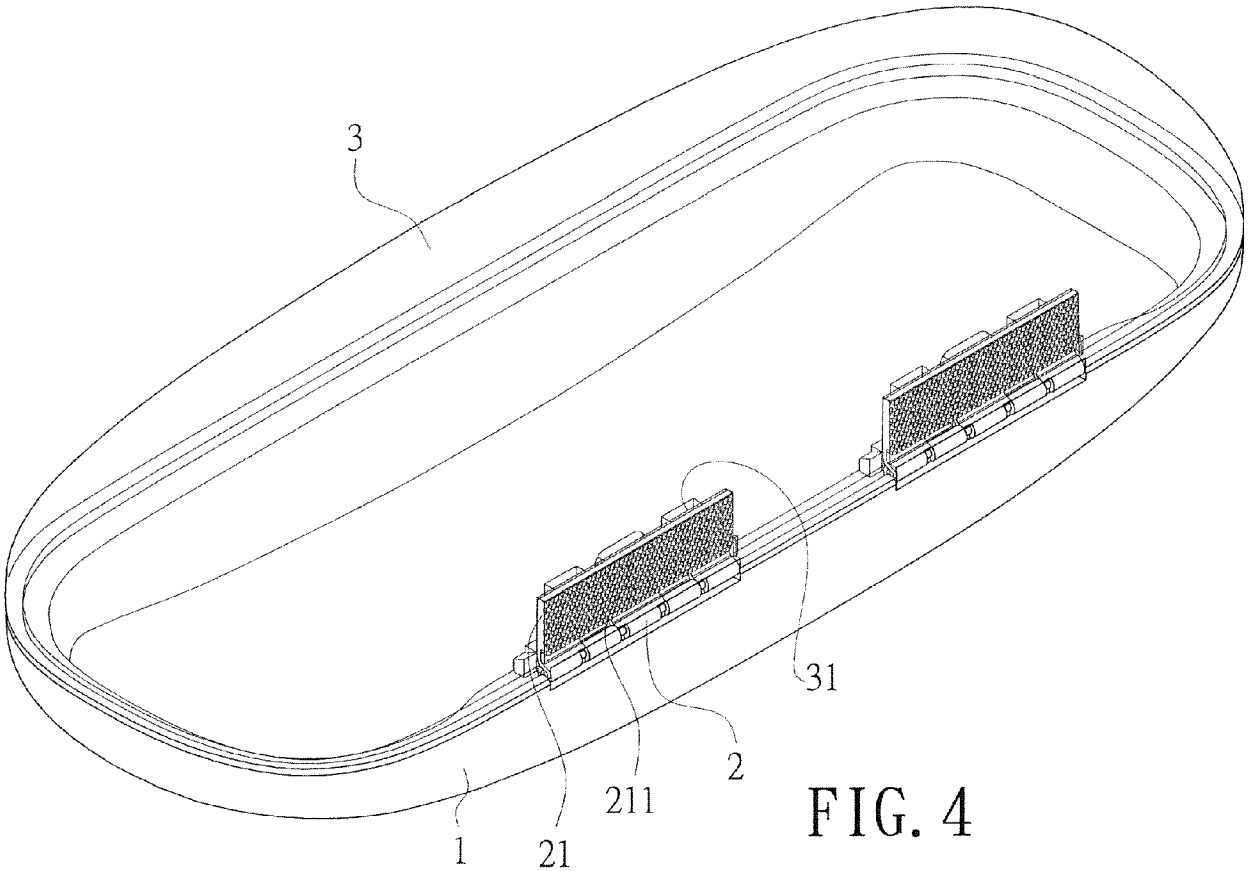
FIG. 4 shows the pivotal members of the eyeglasses storage box of the present invention.
Figure 5:
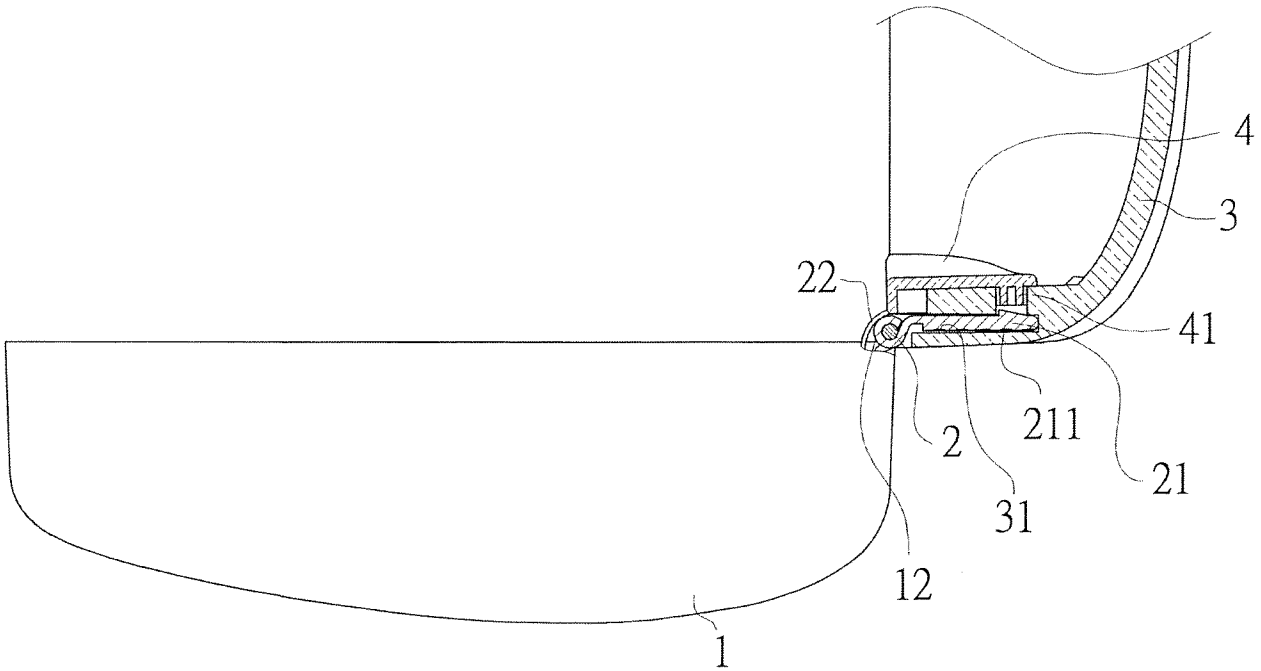
FIG. 5 is a cross sectional view to show the pivotal connection between the core and the body of the eyeglasses storage box of the present invention.
Figure 6:
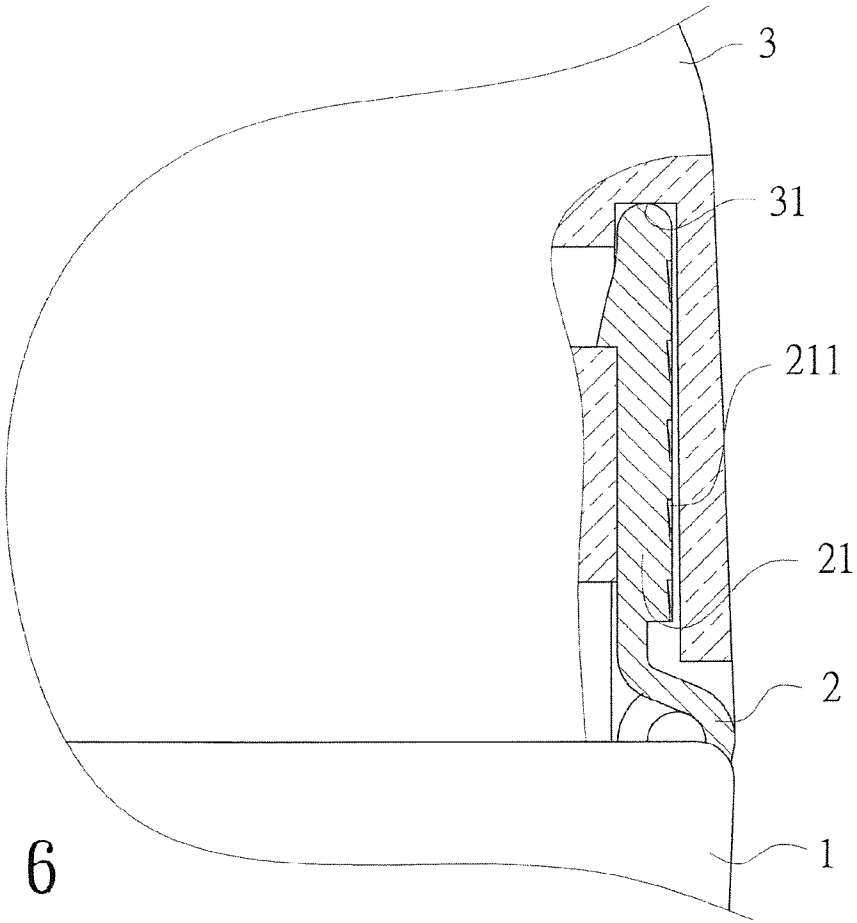
FIG. 6 is an enlarged cross sectional view to show the pivotal connection between the core and the body of the eyeglasses storage box of the present invention.

Referring to FIGS. 1 to 3, the eyeglasses storage box of the present invention comprises a body 1 having a space 11 defined therein and two pivotal portions 12 are connected to one side of the body 1. An inner case 13 is connected to the inside of the space 11 so as to receive the eyeglasses in the space 11. Two protrusions 131 are formed on the inner case 13 and located corresponding to the pivotal portions 12.

Two pivotal members 2 each have the first end thereof connected to the pivotal portion 12 corresponding thereto. An insertion 21 extends from the second end of each of the pivotal members 2. A serrated surface 211 is formed on the outside of each of the insertions 21.

A cover 3 made by transparent material and has two engaging slots 31 which are located corresponding to the insertions 21. Two holes 32 are defined through the cover 3 and located beside to each of the engaging slots 31.

Two protection plates 4 each have two blocks 41 which are engaged with the holes 32 of the cover 3.

The pivotal members 2 each have a resilient plate 22 and the protection plate 4 corresponding to each of the pivotal members 2 has a guide slot 42 in which the resilient plate 22 is received. The inner case 13 has two recesses 132 so as to receive the resilient plates 22 respectively.

As shown in FIGS. 1 to 5, when assembling, the pivotal portions 12 of the body 1 are connected to the pivotal members 2, and the insertions 21 of the pivotal members 2 are inserted into the engaging slots 31 of the cover 3. The inner case 13 is installed to the space 11 and the protrusion 131 cover up the connection portions between the pivotal portions 12 and the pivotal members 2. The resilient plates 22 are received in the recesses 132 of the protrusions 131. The blocks 41 of the protection plates 4 are engaged with the holes 32 of the cover 3 to connect the protection plates 4 to the cover 3. The guide slots 42 of the protection plate 4 receive the two resilient plates 22 on the pivotal members 2.

As shown in FIGS. 1 to 6, when in use, the eyeglasses are received in the inner case 13 and the cover 3 can be opened or closed relative to the body 1. The body 1 has an outer case 5 connected to the outside thereof. When the user opens the cover 3 relative to the body 1, the resilient plates 22 of the pivotal members 2 located on one side of the body 1 and the cover 3 extend toward the inner case 13 of the body 1. By the recesses 132 of the inner case 13, the resilient plates 22 are guided by the recesses 132 and extend within the recesses 132 so that the resilient plates 22 do not contact the inner case 13 directly and the inner case 13 is not damaged by the frequent touch by the resilient plates 22 for a period of time of use. The inner case 13 can also be reinforced to prevent being damaged by the resilient plates 22 if the resilient plates 22 contact the inner case 13 in some situations. The recesses 132 allow the resilient plates 22 to extend without touching the inner case 13 so that the inner case 13 is not separated from the body 1.

The blocks 41 on the protection plates 4 are engaged with the holes 32 of the cover 3 to let the protection plates 4 to cover up the pivotal members 2 on the cover 3, so that when the cover 3 is opened or closed relative to the body 1, the eyeglasses are prevented from being in contact with the pivotal members 2 by the protection plates 4. The protection plates 4 cover up the pivotal members 2 on the cover 3 to obtain the aesthetic appearance of the cover 3.

The serrated surfaces 211 on the insertions 21 have diamond-shaped patterns, rectangular patterns, triangular patterns, rhombus patterns or wave pattern. Therefore, when the insertions 21 are inserted into the engaging slots 31, the serrated surfaces 211 refract light such that the user cannot see the friction on the insertions 21 and the engaging slots 31. The serrated surfaces 211 are also helpful for securing the insertions 21 to the engaging slots 31. The eyeglasses can be seen via the transparent cover 3 without opening the cover 3.

There are several advantages of the present inventions. The recesses 132 allow the resilient plates 22 to extend without touching the inner case 13 so that the inner case 13 is not directly in contact with the resilient plates 22 and can be protected from being damaged. The protrusions 131 reinforce the structure of the inner case 13.

The protection plates 4 cover up the pivotal members 2 on the cover 3, so that the eyeglasses are prevented from being in contact with the pivotal members 2 by the protection plates 4. The protection plates 4 cover up the pivotal members 2 on the cover 3 to obtain the aesthetic appearance of the cover 3.

The serrated surfaces 211 make the user not see the friction on the insertions 21 and the engaging slots 31. The serrated surfaces 211 are also helpful for securing the insertions 21 to the engaging slots 31. The eyeglasses can be seen via the transparent cover 3 without opening the cover 3.

While we have shown and described the embodiment in accordance with the present invention, it should be clear to those skilled in the art that further embodiments may be made without departing from the scope of the present invention.

What is claimed is:

1. An eyeglasses storage box comprising:

a body having a space defined therein, at least one pivotal portion connected to one side of the body, an inner case connected to an inside of the space, at least one protrusion formed on the inner case and located corresponding to the at least one pivotal portion;

at least one pivotal member having a first end connected to the at least one pivotal portion, an insertion extending from a second end of the at least one pivotal member, a serrated surface formed on an outside of the insertion;

a cover made by transparent material and having an engaging slot which is located corresponding to the insertion, a hole defined through the cover and located beside to the engaging slot, and at least one protection plate having a block which is engaged with the hole of the cover.

2. The storage box as claimed in claim 1, wherein the at least one pivotal member has a resilient plate and the protection plate has a guide slot in which the resilient plate is received, the inner case has a recess in which the resilient plate is received.

3. The storage box as claimed in claim 1, wherein the body has an outer case connected to an outside thereof.

4. The storage box as claimed in claim 1, wherein the serrated surface has diamond-shaped patterns, rectangular patterns, triangular patterns, rhombus patterns or wave patterns.

5. The storage box as claimed in claim 2, wherein the body has an outer case connected to an outside thereof.

6. The storage box as claimed in claim 2, wherein the serrated surface has diamond-shaped patterns, rectangular patterns, triangular patterns, rhombus patterns or wave patterns.

* * * * *